US007776186B2

(12) United States Patent
Westerkamp et al.

(10) Patent No.: US 7,776,186 B2
(45) Date of Patent: Aug. 17, 2010

(54) TRANSPORT BELT

(75) Inventors: Arved H. Westerkamp, Dettingen/Erms (DE); Matthias Schmitt, Munich (DE)

(73) Assignee: Voith Patent GmbH, Heldenheim (DE)

( * ) Notice: Subject to any disclaimer, the term of this patent is extended or adjusted under 35 U.S.C. 154(b) by 566 days.

(21) Appl. No.: 11/626,675

(22) Filed: Jan. 24, 2007

(65) Prior Publication Data

US 2007/0169910 A1 Jul. 26, 2007

(30) Foreign Application Priority Data

Jan. 26, 2006 (DE) ..... 10 2006 003 708

(51) Int. Cl.
*D21F 3/02* (2006.01)
*B32B 33/00* (2006.01)

(52) U.S. Cl. ..... 162/358.4; 162/306; 162/901; 428/195.1; 428/196

(58) Field of Classification Search ..... 162/116, 162/348, 358.1, 358.2, 361, 900–904, 306, 162/358.4, 199; 428/195.1, 196, 206, 207
See application file for complete search history.

(56) References Cited

U.S. PATENT DOCUMENTS

| | | | | |
|---|---|---|---|---|
| 3,657,068 | A * | 4/1972 | Ivanowicz | 162/358.2 |
| 3,720,578 | A * | 3/1973 | Heling et al. | 162/116 |
| 4,187,618 | A * | 2/1980 | Diehl | 34/523 |
| 4,300,982 | A * | 11/1981 | Romanski | 162/358.2 |
| 4,511,361 | A * | 4/1985 | Shah | 8/471 |
| 5,233,918 | A * | 8/1993 | Hale | 101/122 |
| 5,456,171 | A * | 10/1995 | Biava et al. | 101/122 |
| 5,462,642 | A * | 10/1995 | Kajander | 162/116 |
| 6,203,663 | B1 * | 3/2001 | Kamps et al. | 162/109 |
| 6,205,920 | B1 * | 3/2001 | Dzierzynski et al. | 101/217 |
| 6,962,885 | B1 | 11/2005 | Best | |
| 2003/0102098 | A1 * | 6/2003 | Allen et al. | 162/203 |
| 2004/0126544 | A1 * | 7/2004 | Jaglowski et al. | 428/196 |
| 2004/0154774 | A1 * | 8/2004 | Rose | 162/211 |
| 2006/0085998 | A1 * | 4/2006 | Herman et al. | 34/453 |
| 2006/0085999 | A1 * | 4/2006 | Scherb et al. | 34/453 |

FOREIGN PATENT DOCUMENTS

| | | |
|---|---|---|
| DE | 102004027733 | 1/2005 |
| EP | 0576115 | 12/1993 |

OTHER PUBLICATIONS

DE 10200402773, Jan. 2005, European Patent Office machine translation.*
European Search Report for EP06126084 dated May 11, 2007.

* cited by examiner

*Primary Examiner*—Eric Hug
(74) *Attorney, Agent, or Firm*—Greenblum & Bernstein, P.L.C.

(57) ABSTRACT

A transport belt, in particular for machines for the production of web material such as paper or paperboard, having a printed material at least in some regions on a web material contact side.

9 Claims, 1 Drawing Sheet

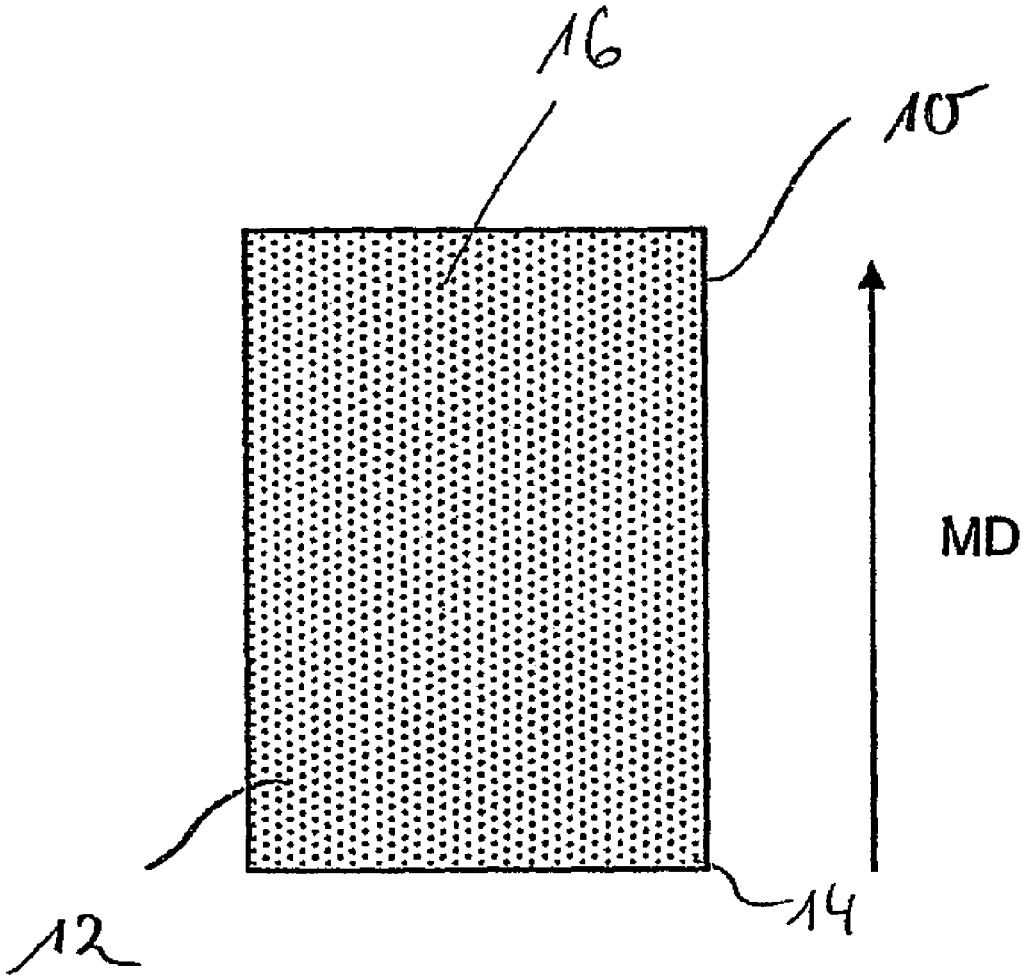
16
10
MD
12
14

TRANSPORT BELT

CROSS-REFERENCE TO RELATED APPLICATIONS

The present application claims priority under 35 U.S.C. §119 of German Patent Application No. 10 2006 003 708.1, filed on Jan. 26, 2006, the disclosure of which is expressly incorporated by reference herein in its entirety.

BACKGROUND OF THE INVENTION

1. Field of the Invention

This invention relates to a transport belt and, more particularly, to a transport belt used on machines for the production of web material such as paper or paperboard.

2. Discussion of Background Information

Transport belts are used in the production of paper, for example, in regions in which wet paper material is passed through press sections in order to remove liquid still present in the material. A thin liquid film from the water pressed out of the material forms between the transport belt and the web material as the material passes through two press rollers, for example. Generally, the transport belt is impermeable to water in order to provide as smooth a surface as possible and produce an accordingly unstructured image of this surface on the web material.

However, a problem arises at the point where the transport belt is separated from the web material. More specifically, the existing thin film of liquid or water produces an adhesive effect which impairs the releasing of the web material from the transport belt.

U.S. Pat. No. 6,962,885 B1 attempts to combat this problem by providing, on the side of the transport belt which comes into contact with the web material, a thin layer which does not have a flat or smooth surface structure but a multiplicity of small depressions. The multiplicity of small depressions can be formed during the production of the thin layer by embedding grains of salt in the material. Where the gains of salt are not fully embedded they can be subsequently removed by dissolving in water, thus obtaining hollow spaces or depressions open to the surface. Water pressed out of the web material can be collected in these depressions and the adhesive effect can be at least lessened.

In EP 0 576 115 B1, the surface of the transport belt which comes into contact with the web material is provided with a comparatively rough structure and, this region of the transport belt, is formed from an elastic material. When the material is pressed between two press rollers, the comparatively rough surface is compressed. After the material has passed through this press roller region the compressed transport belt relaxes, with the result that the serrated elevations forming the surface roughness create a disturbance in the existing water film. This makes it easier for the transport belt to separate from the web material.

Another problem with such transport belts is that, in the initial phase of its working life, the surface characteristic of the belt is changed by the contact that takes place with the web material. Particles contained in the web material, for example, micro fibers or the like, are pressed, particularly in press sections, into the surface of the transport belt and remain stuck to or in the region of this surface. Also, the compression of the transport belt's own construction material leads, in the initial phase of the transport belt's working life, to changing surface properties and hence to a changed interaction between the transport belt and the web material. This can impair the releasing of the transport belt from the web material to be produced.

SUMMARY OF THE INVENTION

The invention provides a transport belt, for machines for the production of web material such as paper or paperboard which, throughout the transport belt's working life, produces web material of high quality without the risk of unwanted adhesion. This is accomplished by a transport belt, for machines for the production of web material such as paper or paperboard, which is printed at least in some regions with printing material.

Printing the transport belt, at least in some regions on its web material contact side, generates various effects. First, it is possible by use of the applied printing material to generate local regions which have surface properties different from the otherwise existing surface properties of the transport belt. Consequently, the disturbances introduced into the interaction between the transport belt and the web material make it easier for a liquid film generated between these two elements to tear and enable any unwanted adhesive effect when the transport belt is separated from the web material. Furthermore, the local application of printing material exerts an influence on the previously described effect of particles from the web material being worked into the surface region of the transport belt.

Where there is printing material, such particles are first embedded in the surface of the printing material while, as the result of the existing pressure, particles from the printing material are worked into the surface region of the transport belt. The printing material is preferably of such condition that, after a comparatively short working period, it is dissolved by the liquid contained in the web material or generally worn off such that the then exposed surfaces of the transport belt have a different surface property than the surface regions that were exposed directly to interaction with the web material from the beginning of its working life.

It has been found that as the result of this selective influencing of the run-in behavior it is advantageously possible to influence the subsequently resulting release properties of the web material. It is also possible, by using a printing material whose surface property approximates the surface property of the transport belt which the belt will have after the run-in phase, to ensure that approximately those surface properties exist from the beginning of the working life as will also exist throughout the working life. Also, the more the printing material is removed, the more the actual surface of the transport belt comes into contact with the paper material, thus making it possible to obtain a continuous transition from the surface of the printing material to a surface of the transport belt with corresponding run-in properties.

The printing material can be printing ink or writing ink, for example.

Furthermore, it is possible to apply the printing material at least in some regions in a regular print pattern. Alternatively, it is possible to apply the printing material at least in some regions in an irregular pattern. The surface to be covered with the printing material can have a surface fraction of the web material contact side in the range from approximately 20% to 100%.

So that marking effects are generated as little as possible in the web material by the printing material, even in the initial stage of the working life of such a transport belt, the thickness of the printing material is less than approximately 50 μm.

Furthermore, the area of individual printing material segments can be in the range from approximately 0.5 $mm^2$ to 5 $mm^2$.

In another aspect of the invention, a transport belt comprises a web material contact side having printing material thereon. In embodiments, the printing material is comprised of printing ink or writing ink. The printing material is provided on the web material contact side in a regular print pattern. The printing material is provided on the web material contact side in an irregular print pattern.

The surface fraction of the web material contact side, printed with the printing material, is in a range from approximately 20% to 100%. The thickness of the printing material is less than 50 μm. The area of individual printing material segments of the printing material is in a range from approximately 0.5 $mm^2$ to 5 $mm^2$. The transfer belt is adapted for use in machines for production of paper or paperboard. The printing material generates local regions which have surface properties different from remaining surface properties of the web material contact side. The printing material has surface properties which approximate a surface property of the transport belt after a run-in phase. The printing material is in at least one of a dot pattern and a stripe pattern. The size of individual print elements of the printing material is in a range of about 2 $mm^2$. The printing material on a side facing away from the web material contact side which interacts with the drive or guide rollers.

In another aspect of the invention, the transport belt comprises a web material contact side having printing material thereon provided in predetermined regions which comprise a surface fraction of the web material contact side in a range from approximately 20% to 100%. The surface properties of the printing material during a run-in phase approximates surface properties of the web material contact side after the run-in phase in the predetermined regions.

In further embodiments, the printing material on a side facing away from the web material contact side. The printing material is comprised of printing ink or writing ink. The thickness of the printing material is less than 50 μm. The area of individual printing material segments of the printing material is in a range from approximately 0.5 $mm^2$ to 5 $mm^2$. The web material contact side which was exposed to web material during the run-in phase has different surface properties than the web material contact side which had printing material thereon provided in the predetermined regions.

In another aspect of the invention, a method comprises providing printing material on portions of a web contact side of a transport belt; and gradually wearing off the printing material during run-in phase of the transport belt by liquid contained in web material to be produced. In embodiments, the surface properties of the printing material substantially match surface properties of the transport belt after the run in phase. The web material to be produced comes into contact with portions of the transport belt that do not have the printing material such that ultra-fine particles from the web material to be produced works into the surface of the transport belt where there is no covering of the printing material.

BRIEF DESCRIPTION OF THE DRAWINGS

The present invention is further described in the detailed description which follows, in reference to the noted drawing by way of non-limiting examples of exemplary embodiments of the present invention, wherein:

The FIG. 1 shows, in a plan view, a detail of a transport belt constructed according to the invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawing making apparent to those skilled in the art how the several forms of the present invention may be embodied in practice.

The transport belt 10, shown partly and in a plan view in the FIG. 1, can be configured in terms of its basic construction along generally known lines. In other words, the transport belt 10 is constructed in regions from flexible material, for example, polyurethane or the like, and has, for example, in a central region, a reinforcement made from fiber material, woven fibers, knitted fibers, helical thread elements or the like. Of course, the transport belt 10 can be constructed from multiple layers such that it is adapted in its various regions respectively to various requirements. For example, the region of the transport belt 10 which faces away from a web material to be produced and generally comes into contact with guide or drive elements can be made from a more robust material or be coated with a more robust material in order keep the wear in this region as small as possible.

On its web material contact side 12 provided for contact with the web material to be produced, the transport belt 10 can be constructed with a substantially smooth, unstructured web material surface 14. In this way, the risk of the web material to be produced being marked by any structuring of the surface of the transport belt 10 is largely eliminated.

Printed on the transport belt 10, on its web material contact side 12, is a dot-like pattern 16. The dot-like pattern 16 can be applied by using various printing methods. For example, the dot-like pattern can be applied using letterpress printing, offset printing, gravure printing or screen printing. The printing material can be conventional printing ink or writing ink. The applied printing material has a thickness which should preferably not exceed approximately 50 μm. The size of the individual print elements, e.g., the individual dots in the illustrated example, should be in a range of about 2 $mm^2$, and a fraction of the surface of the transport belt 10 covered with printing material on the web material contact side 12 can be in the range from approximately 20% to 100%.

Various effects are achieved by applying the printing material to the transport belt 10. Generally the printing material will differ from the construction material of the transport belt 10, on the web material contact side 12, such that an overall surface is first created which, given a surface coverage of less than 100%, is provided by regions of various materials. This results in various surface properties, and more particularly various surface energies which, in turn, has an advantageous influence on the release behavior of the transport belt 10 from the web material, for example, after passing through a press section in the production of paper. Thus, a thin water film formed between the transport belt 10 and the web material will be easier to tear, due to the local disturbances caused by the junctions between the printing material and the construction material of the transport belt 10, when the web material is separated from the transport belt 10 (compared to a uniform surface constructed from the same continuous material).

Another effect of applying the printing material is that, in the run-in phase, e.g., at the beginning of the working life of the transport belt 10, those regions in which printing material exists are covered while the surface regions which are not covered with printing material come into direct contact with the processed web material or web material to be produced. This has the result, firstly, that in these various regions there will be various compressive loads on the surface of the transport belt 10 and, secondly, that ultra-fine particles from the web material to be produced can work into the surface of the transport belt 10 where there is no covering of printing material. Where there is printing material, such particles are first pressed into the surface region of the printing material, not into the actual surface of the construction material of the transport belt 10.

However, in the border region between the construction material of the transport belt 10 and the printing material, a small fraction of the printing material is pressed or worked into the near-surface region of the construction material of the transport belt by the pressure existing in the production process. In the course of the transport belt's working life, the printing material is gradually worn off and/or dissolved by liquid contained in the web material to be produced. As a result, the surface areas which previously were completely covered with printing material are gradually exposed.

However, because a certain fraction of the printing material always remains in the construction material of the transport belt, in the near-surface region, these surface regions will also have a different surface characteristic or surface energy than those regions which were not covered with printing material from the beginning. Even when subsequently more and more particles from the web material are worked into these surface regions, this will result in variations in the surface characteristic which, in turn, will lead locally to disturbances in the interaction between the transport belt 10 and the liquid film, e.g., generally water film. In this manner, the release of the web material is made easier in the region in which the transport belt 10 is separated from the web material.

Given a surface coverage with printing material in the range of 100% or nearly 100%, the entire surface of the transport belt 10 is covered at the beginning of its working life and therefore does not come into contact with the web material to be produced. The printing material has surface properties which approximate the surface properties which the transport belt 10 will have on its web material contact surface after the run-in phase. Through the gradual wearing off or gradual dissolving of the printing material in the run-in phase, a gradual transition takes place from the surface properties of the printing material to the surface properties of the transport belt 10 after the run-in phase is completed. Consequently, practically no changes in the surface characteristics arise either in the run-in phase or when changing over to the normal operating phase and therefore production with essentially constant quality is possible from the very beginning.

It should be noted that the pattern used to apply the printing material is not required to be very regular, as shown in the FIG. 1. For example, any statistical distribution of individual print elements, which can also vary in size, is contemplated by the invention. Similarly the application of stripe patterns or the like is contemplated by the invention. Also, in embodiments, consideration could be given to printing the rear of the transport belt 10, e.g., the side facing away from the web material contact side and interacting with the drive or guide rollers. This could be advantageous for reasons of wear reduction, for example.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A transport belt, comprising:

a web material contact side having printing material thereon provided in predetermined regions which comprise a surface fraction of the web material contact side in a range from approximately 20% to 100%, wherein surface properties of the printing material during a run-in phase approximates surface properties of the web material contact side after the run-in phase in the predetermined regions.

2. The transport belt according to claim 1, further comprising printing material on a side facing away from the web material contact side.

3. The transport belt according to claim 1, wherein the printing material is comprised of printing ink or writing ink.

4. The transfer belt according to claim 1, wherein a thickness of the printing material is less than 50 μm.

5. The transfer belt according to claim 4, wherein an area of individual printing material segments of the printing material is in a range from approximately 0.5 $mm^2$ to 5 $mm^2$.

6. The transfer belt according to claim 1, wherein the web material contact side which was exposed to web material during the run-in phase has different surface properties than the web material contact side which had printing material thereon provided in the predetermined regions.

7. A method, comprising:

applying printing material to at least portions of a web contact side of a transport belt; and gradually wearing off the printing material during run-in phase of the transport belt by liquid contained in web material to be produced.

8. The method of claim 7, wherein surface properties of the printing material substantially match surface properties of the transport belt after the run in phase.

9. The method of claim 8, wherein the web material to be produced comes into contact with portions of the transport belt that do not have the printing material such that ultra-fine particles from the web material to be produced works into a surface of the transport belt where there is no covering of the printing material.

* * * * *